US012391513B2

(12) United States Patent
Moore et al.

(10) Patent No.: US 12,391,513 B2
(45) Date of Patent: Aug. 19, 2025

(54) FIREHOSE WINDING APPARATUS

(71) Applicant: Rich Moore Design LLC, Seligman, AZ (US)

(72) Inventors: Richard Elliot Moore, Seligman, AZ (US); Richard Gerald Moore, Seligman, AZ (US)

(73) Assignee: RICH MOORE DESIGN LLC, Seligman, AZ (US)

( * ) Notice: Subject to any disclaimer, the term of this patent is extended or adjusted under 35 U.S.C. 154(b) by 235 days.

(21) Appl. No.: 18/117,984

(22) Filed: Mar. 6, 2023

(65) Prior Publication Data

US 2024/0300777 A1 Sep. 12, 2024

(51) Int. Cl.
*B65H 75/42* (2006.01)
*B65H 75/44* (2006.01)

(52) U.S. Cl.
CPC ..... *B65H 75/425* (2013.01); *B65H 75/4402* (2013.01); *B65H 75/4494* (2013.01); *B65H 2701/332* (2013.01)

(58) Field of Classification Search
CPC ..... B65H 75/425; B65H 75/4402; B65H 75/4494; B65H 54/585; B65H 2701/332
See application file for complete search history.

(56) References Cited

U.S. PATENT DOCUMENTS 4,265,414 A * 5/1981 Spradling ..... B65H 54/585 242/537
5,033,690 A * 7/1991 McIver ..... B65H 54/585 242/615.3
5,988,559 A * 11/1999 Gnass ..... A62C 33/04 242/395
7,793,881 B1 * 9/2010 Torres ..... B65H 54/585 242/532.6

* cited by examiner

*Primary Examiner* — Sang K Kim
(74) *Attorney, Agent, or Firm* — Myers Andras Ashman Bisol LLP; Joseph C. Andras

(57) ABSTRACT

A portable mechanical firehose winder is described. The firehose winder comprises a foldable structure which can be stored and readily transported in a compact, stowed configuration, but can be unfolded in the field to place the firehose winder into a deployed configuration. The firehose winder has a winder mechanism having two pins for securing a firehose connector is mounted on a plate that can be rotated by hand with a crank arm. The firehose winder also has a firehose hold-down mechanism for holding down a firehose as it traverses the winder as well as an adjustable width mechanism for laterally guiding the firehose into the firehose winder mechanism.

20 Claims, 10 Drawing Sheets

FIREHOSE WINDING APPARATUS

BACKGROUND OF THE INVENTION

1. Field of the Invention

The present invention relates in general to firehose winding apparatuses. More particularly, the invention is directed to portable firehose winding apparatuses capable of being folded into a compact, stowable configuration having an adjustable crank arm for reeling firehoses.

2. Description of the Related Art

One of the tasks required of firefighters after a fire is extinguished is to roll up firehoses. In the past, without a hose winder, a firefighter was required to bend over and painstakingly roll up each hose while walking the roll further along. This is tiring and tough on the back. The general need for a hose winder, therefore, is to lessen the strain on a firefighter's back.

There have been some hose winders to date, but the known winders break down into multiple, unwieldy parts and, therefore, are somewhat difficult to carry, deploy, and stow. A winder according to a preferred embodiment of the invention easily folds up and is carried, mounted, used, and stowed as a unit.

Accordingly, a need exists for a firehose winder that easily folds up and is carried, mounted, used, and stowed as a unit.

SUMMARY OF THE INVENTION

In the first aspect, a firehose winder is described. The firehose winder comprises an assembly comprising a tongue for connecting to a hitch of a vehicle, a riser hingeably connected to the tongue, a horizontal main stay tube hingeably connected to the riser, and a firehose winder mechanism attached to the horizontal main stay tube and configured to receive and wind a firehose. The tongue, the riser, and the horizontal main stay tube of the assembly are movable between a closed configuration for stowing the firehose winder and an open configuration where the horizontal main stay tube is reversibly locked and displaced vertically with respect to the tongue.

In a first preferred embodiment, when the assembly is in the closed configuration, the riser is positioned immediately adjacent to and parallel with the tongue, and the horizontal main stay tube is positioned immediately adjacent to and parallel with the riser. The firehose winder mechanism preferably further comprises a center mount plate attached to a shaft and positioned on a side of the horizontal main stay tube opposite a two-piece crank arm, two hose mount pins attached to and extending away from the center mount plate, the two hose mount pins configured to receive and wind the firehose, and an adjustable crank arm coupled to the center mount plate, wherein the handle may be moved away or towards an axis of the shaft. The firehose winder mechanism preferably comprises a shaft positioned through at least one hole formed in the horizontal main stay tube, a two-piece crank arm comprising a near portion and a far portion, near and far being used here in terms of radial distance from the shaft. The near portion is attached to the shaft where the length of the near portion is perpendicular to an axis of the shaft, the far portion is movably coupled to the near portion, and a handle is attached to a distal end of the far portion. The firehose winder mechanism preferably further comprises a center mount plate attached to the shaft and positioned on a side of the horizontal main stay tube opposite the two-piece crank arm, and two hose mount pins attached to and extending away from the center mount plate, the two hose mount pins configured to receive and wind the firehose. The firehose winder preferably further comprises a hold-down mechanism mounted on the horizontal main stay tube for applying a downward force on the firehose as the firehose is wound onto the firehose winder mechanism. The hold-down mechanism preferably comprises a lower slide hose hold-down coupled to the horizontal main stay tube, the lower slide hose down having a first length perpendicular to the horizontal main stay tube and a first curved contour formed perpendicular to the length of the lower slide hose hold-down, an arm rotatably coupled to the horizontal main stay tube, an upper slide hose hold-down rotatably coupled to the arm, the upper slide hose down having a second length perpendicular to the horizontal main stay tube and a second curved contour formed perpendicular to the length of the upper slide hose hold-down, and a spring coupling the horizontal main stay tube and the upper slide hose, the spring urging a downward force onto the firehose.

The firehose winder preferably further comprising an adjustable width mechanism for aligning and guiding the firehose laterally as the firehose is wound onto the firehose winder mechanism. The adjustable width mechanism comprises a fixed hose guide, a hose sizer tube having a plurality of index holes, the hose sizer tube attached to and extending laterally away from the horizontal main stay tube, a guide slider movable coupled to the hose sizer tube, the guide slider having a retractable pin for engaging with the index holes, and a movable hose guide coupled to the guide slider. The firehose winder preferably further comprises a stow pin mount plate attached to the riser, the stow pin mount plate having a length extending perpendicular from a length of the riser, a first retractable pin connected to the stow pin mount plate, the first retractable pin configured to secure the horizontal main stay tube adjacent to the riser and a second retractable pin connected to the stow pin mount plate, the second retractable pin configured to secure the horizontal main stay tube adjacent to the tongue. The assembly preferably further configures a toggle clamp for removably locking the horizontal main stay tube in place when the assembly is in the open configuration.

In a second aspect, a firehose winder is disclosed. The fire hose winder comprises an assembly comprising a tongue for connecting to a hitch of a vehicle, a riser hingeably connected to the tongue, a horizontal main stay tube hingeably connected to the riser, and a firehose winder mechanism attached to the horizontal main stay tube configured to receive and wind a firehose, the firehose winder mechanism having an adjustable crank arm where the handle may be moved relative to an axis of the shaft.

In a second preferred embodiment, the tongue, the riser, and the horizontal main stay tube of the assembly are movable between a closed configuration for stowing the firehose winder and an open configuration where the horizontal main stay tube is reversibly locked and displaced vertically with respect to the tongue. When the assembly is in the closed configuration, the riser is positioned immediately adjacent to and parallel with the tongue, and the horizontal main stay tube is positioned immediately adjacent to and parallel with the riser. The firehose winder preferably further comprises a hold-down mechanism mounted on the horizontal main stay tube for applying a downward force on the firehose as the firehose is wound onto the firehose winder mechanism. The hold-down mechanism preferably comprises a lower slide hose hold-down coupled to the horizontal main stay tube, the lower slide hose down having a first length perpendicular to the horizontal main stay tube and a first curved contour formed perpendicular to the length of the lower slide hose hold-down, an arm rotatably coupled to the horizontal main stay tube, an upper slide hose hold-down rotatably coupled to the arm, the upper slide hose down having a second length perpendicular to the horizontal main stay tube and a second curved contour formed perpendicular to the length of the upper slide hose hold-down, and a spring coupling the horizontal main stay tube and the upper slide hose, the spring urging a downward force onto the firehose.

The firehose winder preferably further comprising an adjustable width mechanism for aligning and guiding the firehose as the firehose is wound onto the firehose winder mechanism. The adjustable width mechanism preferably comprises a fixed hose guide, a hose sizer tube having a plurality of index holes, the hose sizer tube attached to and extending laterally away from the horizontal main stay tube, a guide slider movable coupled to the hose sizer tube, the guide slider having a retractable pin for engaging with the index holes, and a movable hose guide coupled to the guide slider. The firehose winder preferably further comprises a stow pin mount plate attached to the riser, the stow pin mount plate having a length extending perpendicular from a length of the riser, a first retractable pin connected to the stow pin mount plate, the first retractable pin configured to secure the horizontal main stay tube adjacent to the riser, and a second retractable pin connected to the stow pin mount plate, the second retractable pin configured to secure the horizontal main stay tube adjacent to the tongue.

In a third aspect, a firehose winder is disclosed. The firehose winder comprises an assembly comprising a tongue for connecting to a hitch of a vehicle, a riser hingeably connected to the tongue, a horizontal main stay tube hingeably connected to the riser, a firehose winder mechanism attached to the horizontal main stay tube and configured to receive and wind a firehose, and a hold-down mechanism mounted on the horizontal main stay tube for applying a downward force on the firehose as the firehose is wound onto the firehose winder mechanism.

In a third preferred embodiment, the hold-down mechanism preferably comprises a lower slide hose hold-down coupled to the horizontal main stay tube, the lower slide hose down having a first length perpendicular to the horizontal main stay tube and a first curved contour formed perpendicular to the length of the lower slide hose hold-down, an arm rotatably coupled to the horizontal main stay tube, an upper slide hose hold-down rotatably coupled to the arm, the upper slide hose down having a second length perpendicular to the horizontal main stay tube and a second curved contour formed perpendicular to the length of the upper slide hose hold-down, and a spring coupling the horizontal main stay tube and the upper slide hose, the spring urging a downward force onto the firehose.

These and other features and advantages of the invention will become more apparent with a description of preferred embodiments in reference to the associated drawings.

DETAILED DESCRIPTION OF THE PREFERRED EMBODIMENTS

Figure 1:
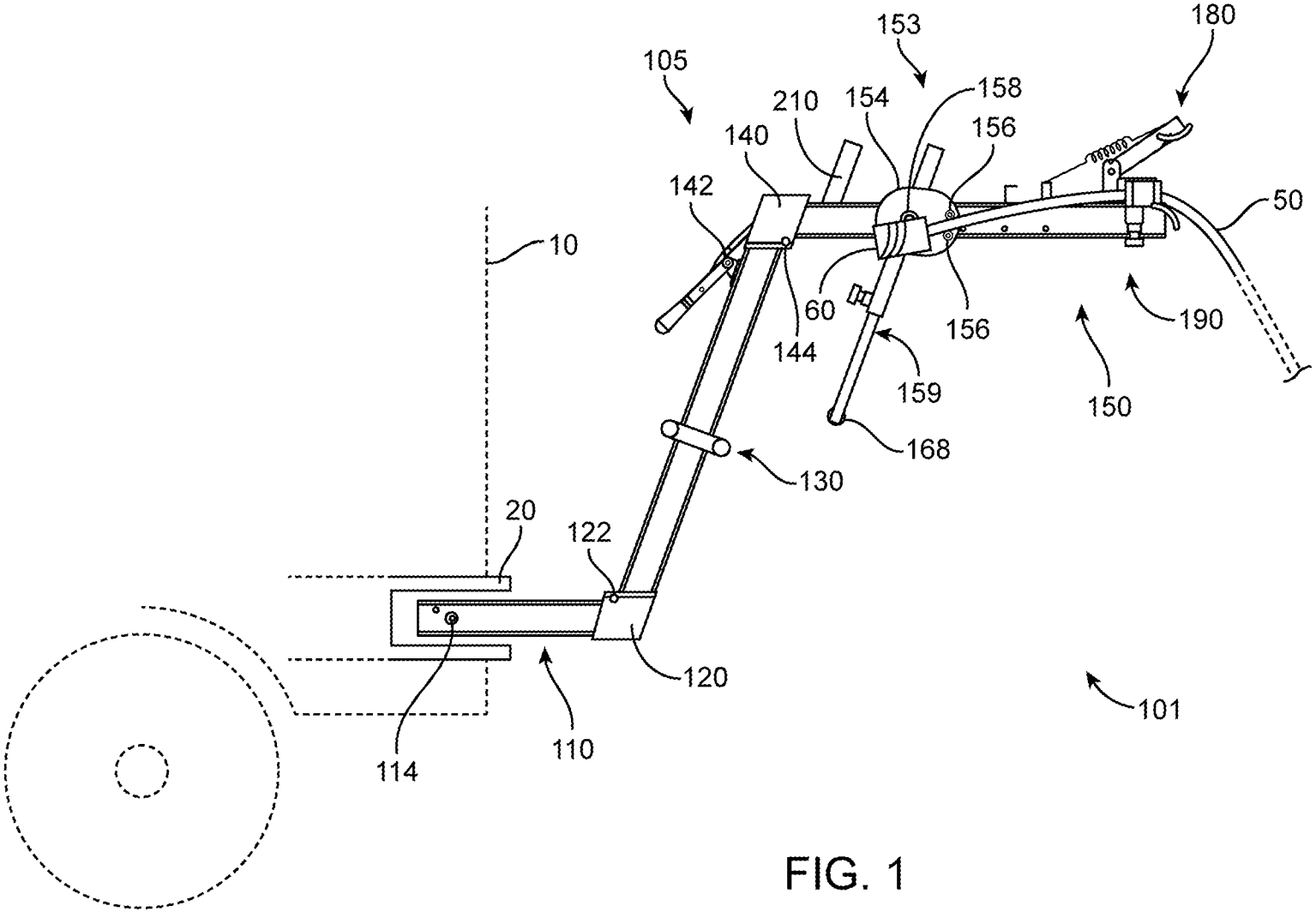
FIG. 1 is a side view of an exemplary firehose winder attached to a vehicle and prepared to roll up a firehose.

Firefighters provide crucial services to the communities in which they work. One of the many tasks required of firefighters is to roll up firehoses that were used while extinguishing a fire. Traditionally, a firefighter would lay out a firehose on the ground in a straight line, and then, starting at one end, roll the firehose by hand. This requires a firefighter to painstakingly roll up each hose while walking the roll further along. This is tiring and tough on the back. The general need for a hose winder, therefore, is to lessen strain on a firefighter's back. While there have been some mechanical hose winders to date, known winders break down into multiple, unwieldy parts and, therefore, are somewhat difficult to carry, deploy, and stow.

A portable mechanical firehose winder is contemplated in one or more embodiments. The firehose winder comprises a foldable structure which can be stored and readily transported in a compact, stowed configuration that can be unfolded to place the firehose winder into a deployed configuration for use in the field. The firehose winder has a winder mechanism having two pins for securing a firehose connector. The two pins are mounted on a plate that can be rotated by hand with a crank arm. The firehose winder also has a firehose hold-down mechanism for slidably holding down a firehose as it traverses the winder toward the winder mechanism, as well as an adjustable width mechanism for accommodating firehoses of different width and for laterally guiding the firehose into the firehose winder mechanism.

A firefighter may roll up a firehose by laying an end of the firehose over the hold-down mechanism through the adjustable width mechanism which can be adjusted to accommodate firehoses of varying widths. The firefighter places the firehose connector between the two pins of the winder mechanism and rotates a crank arm by hand which rotates the two pins and rolls up the firehose. In a preferred embodiment, the length of the crank arm is adjustable so that greater torque may be applied to heavier firehoses simply by extending the length of the crank arm.

As used herein, the term "firehose" refers to high-pressure hoses which carry fluids such as water or other types of fire retardants which are designed to be stored flat to minimize the space required. The terms "vertical" and "horizontal" refer to the orientations of the firehose winder in the deployed configuration, where the term "vertical" refers to an upward direction away from the ground, and the term "horizontal" refers to an orientation generally parallel with the surface of the earth which is perpendicular to the vertical direction. The term "lateral" refers to a direction which is both perpendicular to the horizontal and vertical direction, such as the direction perpendicular to the length (i.e., the length of the horizontal main stay tube) in the same plane as the horizontal main stay tube. The term "substantially" may refer to imprecisions of orientation or alignment of mechanical parts which would be expected as a result of typical mechanical and machining tolerances as well as the orientation affected by the slope and orientation of a vehicle to which mechanical parts are attached. Although embodiments described herein refer to firehoses, it shall be understood that firehose winder described herein may be used by other types of hoses.

FIG. 1 is a side view of an exemplary firehose winder 101 attached to a vehicle 10 and prepared to roll up a firehose 50 in an open, deployed configuration. The firehose winder 101 comprises an assembly 105 comprising a tongue 110 for connecting to a hitch 20 of a vehicle 10. One or more retractable spring-loaded pins 114 on the tongue 110 engage with holes formed on the trailer hitch 20. The assembly 105 further comprises a riser 130 hingeably connected to the tongue 110 which elevates the firehose winding mechanism 153 to a convenient height for the user. The assembly 105 further comprises a horizontal main stay tube 150 hingeably connected to the riser 130. In an embodiment, the tongue 110 is coupled to the riser 130 via a lower guard 120 which has a lower pivot 122 which allows the tongue 110 to rotate away from the riser 130. Likewise, the horizontal main stay tube 150 is coupled to the riser 130 via an upper guard 140 which has an upper pivot 144 which allows the horizontal main stay tube 150 to rotate away from the riser 130. A toggle clamp 142 releasably locks the horizontal main stay tube 150 in place when the firehose winder 101 is in an open, deployed configuration. A carrying handle 210 is provided for conveniently carrying the firehose winder 101 while in the closed, stowed configuration.

A firehose winder mechanism 153 is attached to the horizontal main stay tube 150 and is configured to receive and wind a firehose 50. The firehose winder mechanism 153 comprises a shaft 158 positioned through and movably affixed to at least one hole formed in the horizontal main stay tube 150, a two-piece crank arm 159 attached to the shaft 158 where the length of the two-piece crank arm 159 is perpendicular to the axis of the shaft 158, and a handle 168 attached to a distal end of the two-piece crank arm 159. A center mount plate 154 is attached to the shaft 158 and is positioned on a side of the horizontal main stay tube 150 opposite that of the two-piece crank arm 159. Two hose mount pins 156 are attached to and extends away from the center mount plate 154 where the two hose mount pins 156 are configured to receive and wind the firehose 50.

The hose mounts pins 156 are preferably eccentrically offset from the shaft 158, as shown in FIG. 1, to provide a central location for receiving the connector 60 at the end of the firehose 50. In use, the firefighter typically winds up the male connector 60 in order to protect its external threads on the inside of the roll, the internal threads on the offsite-end female connector (not shown) being inherently protected by their internal location.

A hold-down mechanism 180 is mounted on the horizontal main stay tube 150 for applying a downward force on the firehose 50 as the firehose 50 is wound onto the firehose winder mechanism 153. An adjustable width mechanism 190 is also attached to the horizontal main stay tube 150 and is employed for aligning and guiding the firehose 50 laterally as the firehose 50 is wound onto the firehose winder mechanism 153.

A user in the field would open the assembly 105 by rotating the tongue 110 away from the riser 130, and then by rotating the horizontal main stay tube 150 away from the riser 130. The toggle clamp 142 is engaged to lock the horizontal main stay tube 150 in place. The tongue 110 is placed into and secured by a trailer hitch 20 attached to a vehicle 10 in an embodiment. The user would then retract the locking pin 114 of the tongue 110 and attached the assembly 105 into the trailer hitch 20 of the vehicle 10. During attachment, the firefighter would retract the locking pin 114 of the tongue 110 with an internal spring-loaded rocker mechanism (not shown), insert the tongue 110 into the hitch 20 (aka "receiver"), and securely attach the assembly 105 to the trailer hitch 20 of the vehicle 10 when the spring-loaded locking pin 114 is aligned with and automatically presses outward into a corresponding hole (not shown) in the hitch 20.

A user would them place the connector 60 between the hose mount pins 156 and drape the firehose 50 alongside the length of the horizontal main stay tube 150 and through the hold-down mechanism 180 and the adjustable width mechanism 190.

Figure 2:
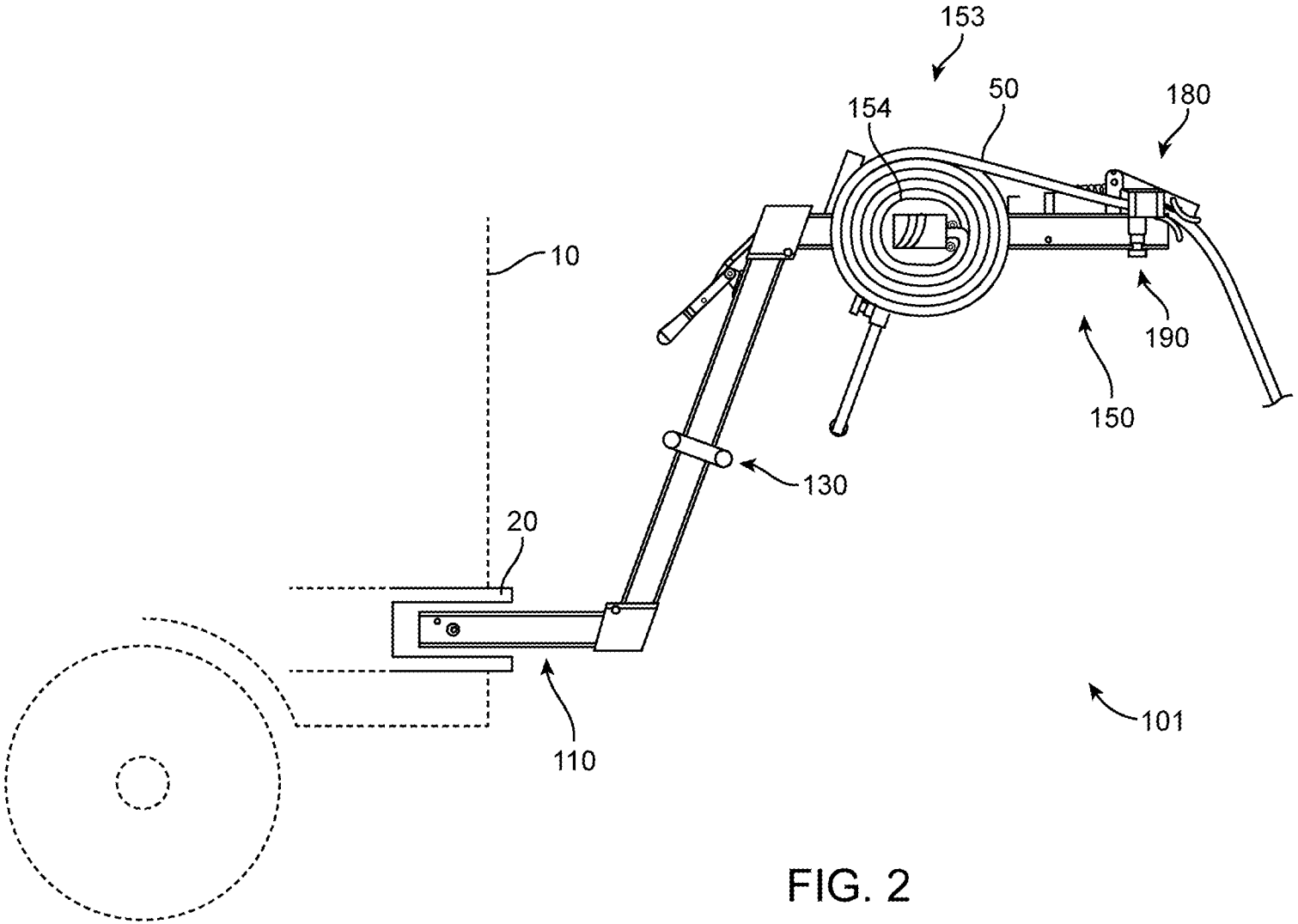
FIG. 2 is a side view of an exemplary firehose winder rolling up the firehose.

As shown in FIG. 2, the hold-down mechanism 180 is set to apply a downward force to the firehose 50 and the adjustable width mechanism 190 is adjusted to laterally guide the firehose 50 into the firehose winder mechanism 153. The user then grabs onto the handle 168 and rotates the crank arm 159, which, in turn rotates the shaft 158, the hose center mount plate 154, and the hose mount pins 156, which rolls the firehose 50. In an embodiment, the crank arm 159 is a two-piece crank arm 159 that is adjustable in length so that the distance between the handle 160 and the shaft 158 can be decreased to wind more rapidly when rolling lighter firehoses or increased to apply greater torque when rolling heavier firehoses. When the firehose 50 is fully wound, the user simply slips the firehose 50 off the hose mount pins 156 of the hose center mount plate 154.

Figure 3:
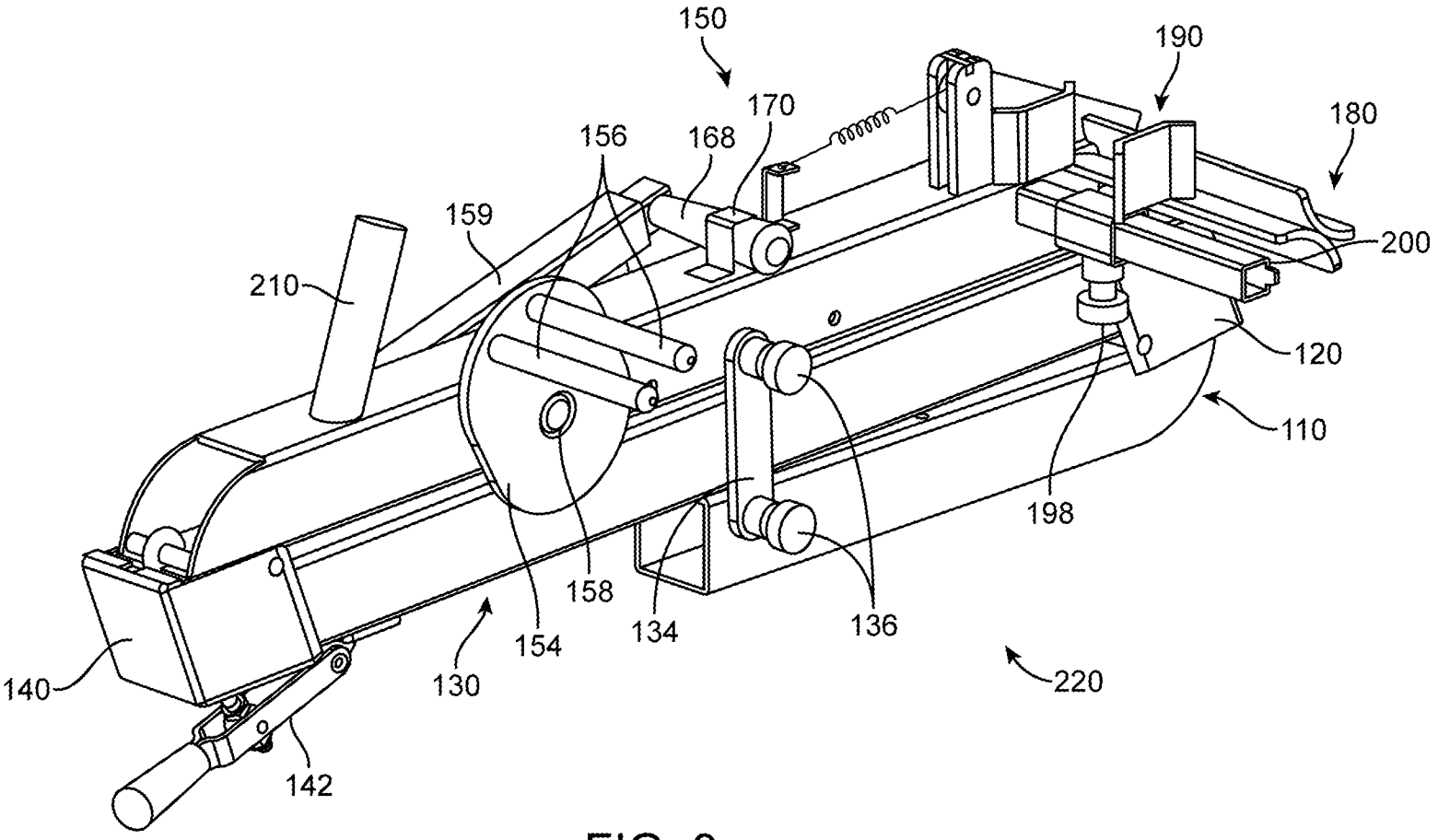
FIG. 3 is a side, perspective view of an exemplary firehose winder in a closed, stowable configuration in one or more embodiments.
Figure 4:
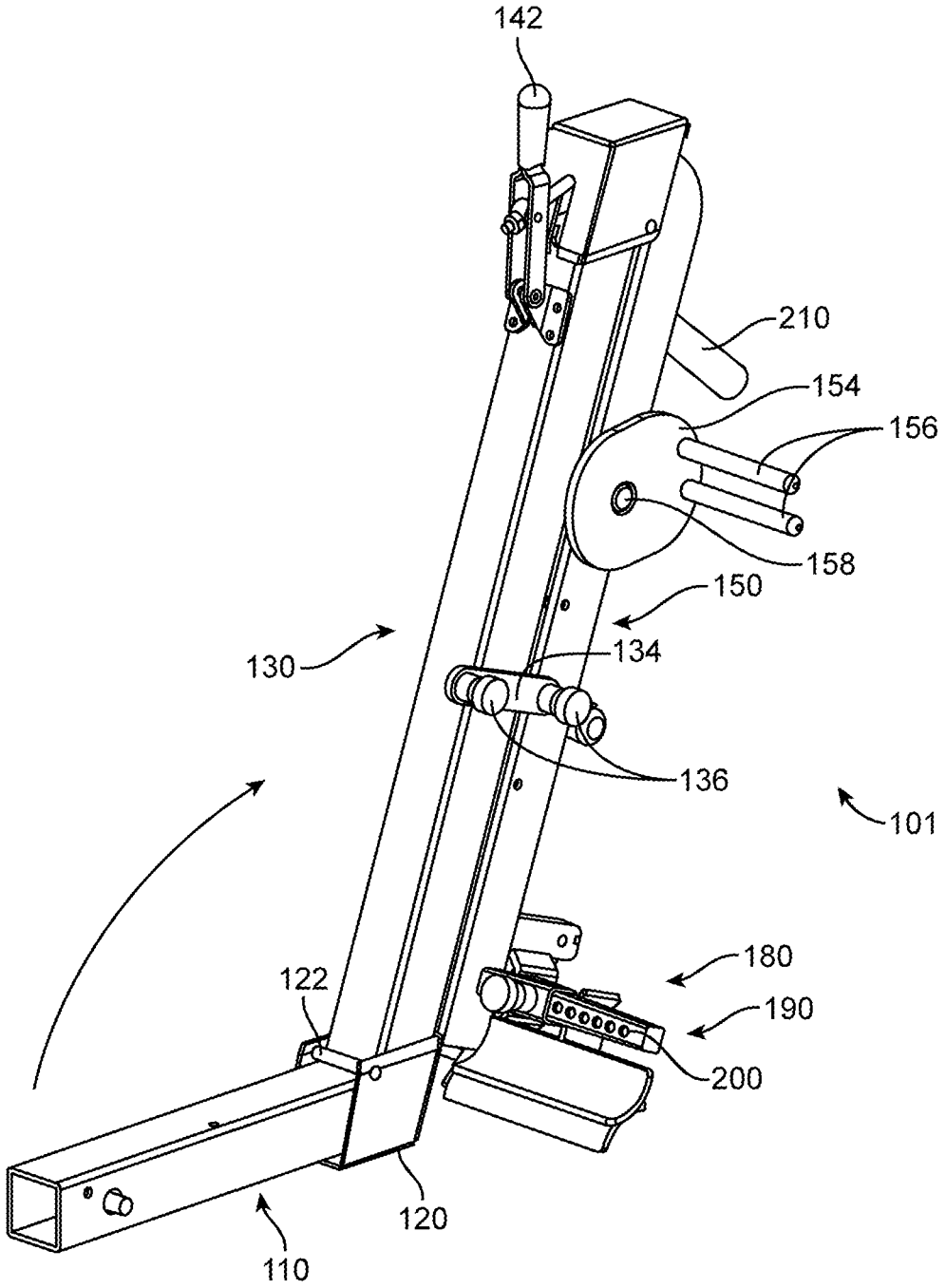
FIG. 4 is a side, perspective view of an exemplary firehose winder being placed into the open configuration, where the riser is rotated away from the tongue.
Figure 5:
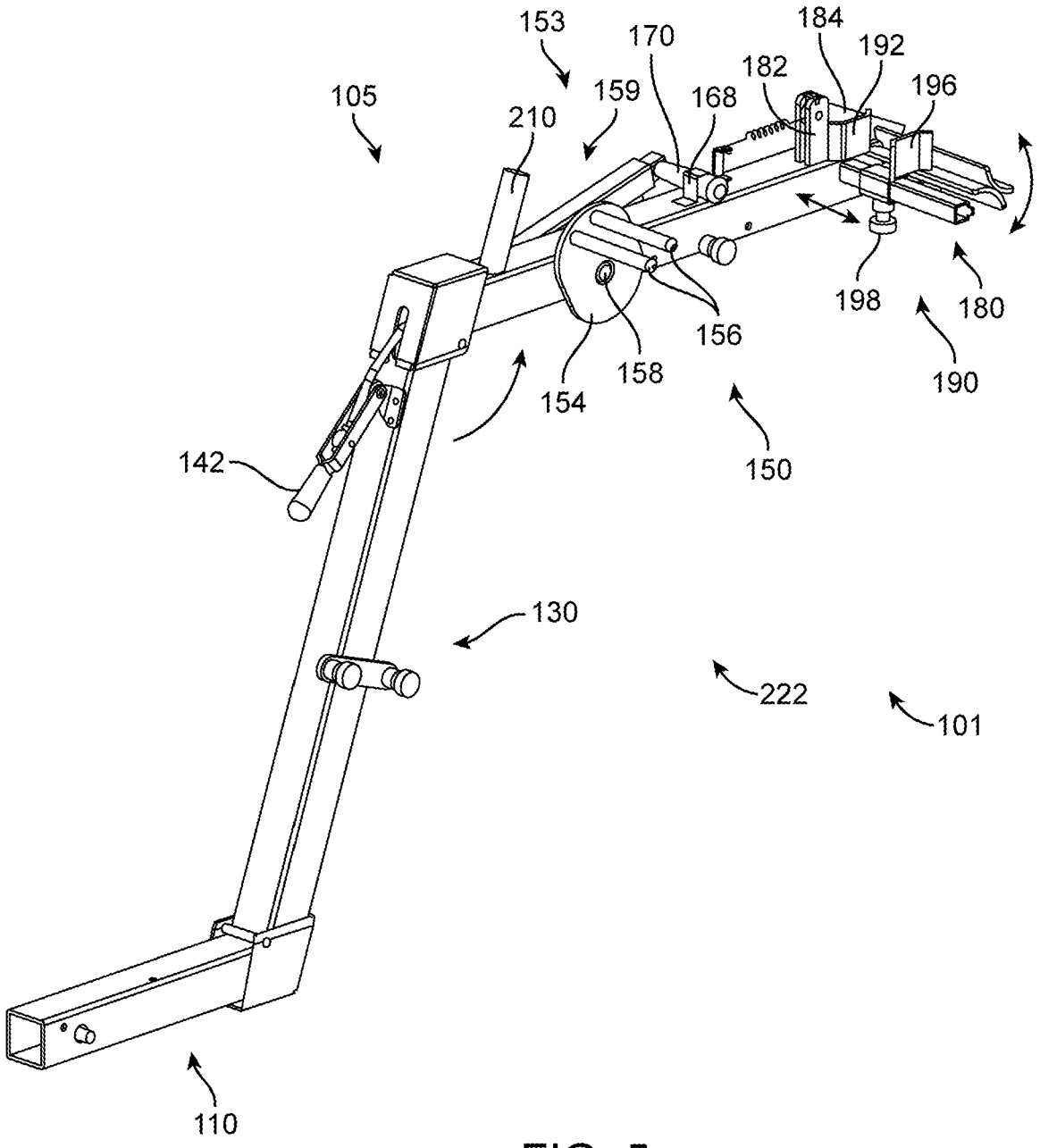
FIG. 5 is a side, perspective view of an exemplary firehose winder being placed into the open configuration.

FIGS. 3-5 are side, perspective views of the firehose winder 101 illustrating the firehose winder in a closed, stowable configuration 220 opening up to be placed in an open, deployable configuration 222 as shown in FIG. 5. Specifically, the tongue 110, the riser 130, and the horizontal main stay tube 150 of the assembly 105 are movable between a closed configuration 220 for stowing the firehose winder 101 and an open configuration 222 where the horizontal main stay tube 150 is reversibly locked and displaced relative to the riser 130 so at to be substantially parallel with respect to the tongue 110.

FIG. 3 is a side, perspective view of an exemplary firehose winder 101 in a closed, stowable configuration 220 in one or more embodiments. When the assembly 105 is in the closed configuration 220, the riser 130 is positioned immediately adjacent to and parallel with the tongue 110, and the horizontal main stay tube 150 is positioned immediately adjacent to and parallel with the riser 130. In an embodiment, a stow pin mount plate 134 having two retractable stow pins 136 are attached to the riser 130. In the closed configuration 220, the two retractable stow pins 136 engage with holes formed in the tongue 110 and the horizontal main stay tube 150 and releasably lock the assembly 105 in the closed configuration 220. The user may open the assembly 105 by retracting the stow retractable pins 136 to release the tongue 110 and the horizontal main stay tube 150 from the riser 130.

FIG. 4 is a side, perspective view of an exemplary firehose winder 101 illustrating the first step in placing the assembly 105 into the open configuration, where the riser 130 is rotated away from the tongue 110. As noted above, the user retracts the retractable stow pins 136, and then rotates the tongue 110 away from the riser 130.

As shown in FIG. 5, the user rotates the horizontal main stay tube 150 away from the riser 130, and then releasably locks the horizontal main stay tube 150 in place by engaging the toggle clamp 142 to place the assembly 105 into the open, deployed configuration 222. Attached to the horizontal main stay tube 150 are the firehose winder mechanism 153, the hold-down mechanism 180, and the adjustable width mechanism 190.

Figure 6:
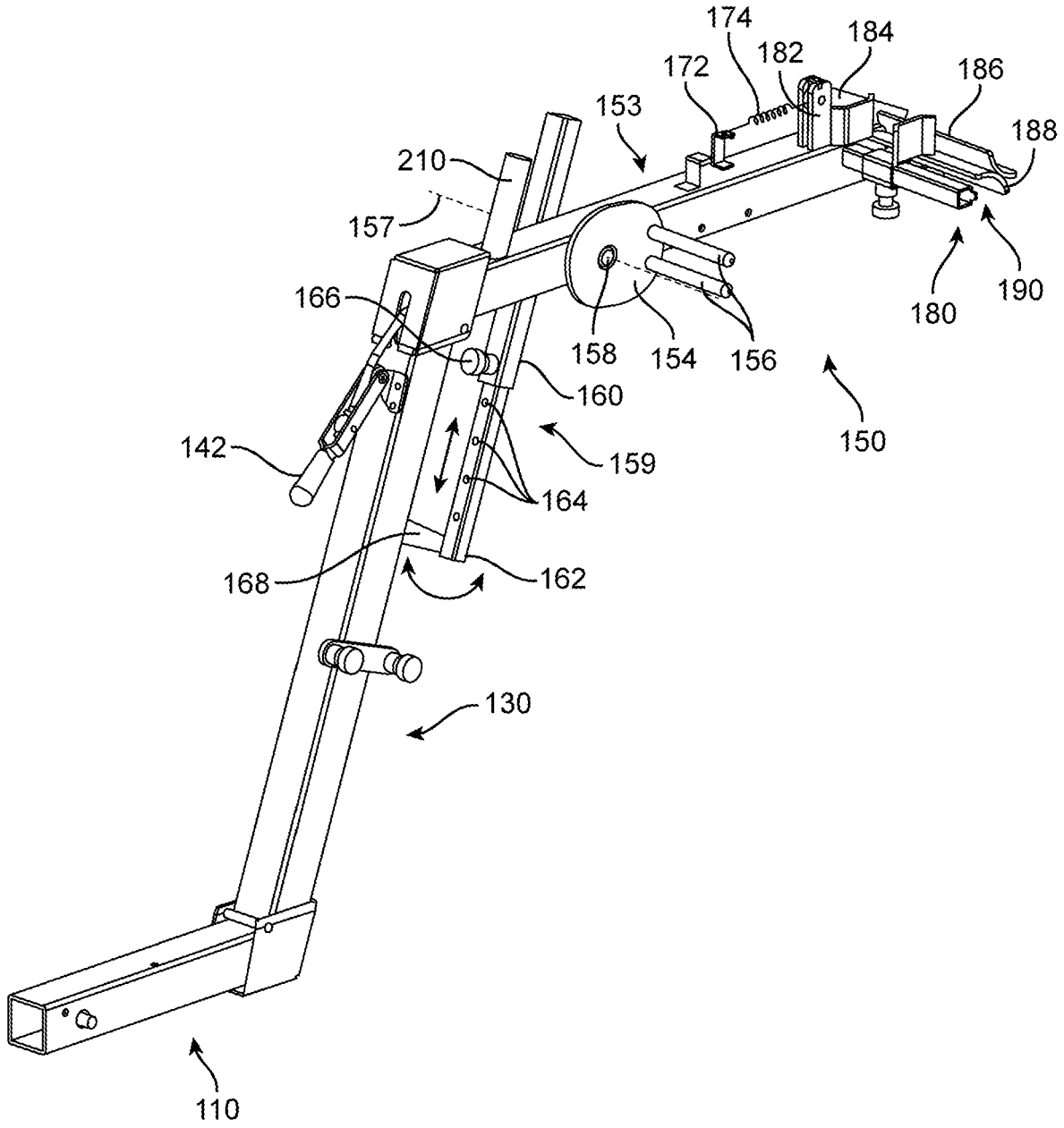
FIG. 6 is a side, perspective view of the firehose winder where the adjustable crank arm is shortened or lengthened to provide greater speed or greater torque for winding the firehose.

The firehose winder mechanism 153 is illustrated in FIGS. 5 and 6. In an embodiment, the firehose winder mechanism 153 comprises a shaft 158 positioned through at least one hole formed in the horizontal main stay tube 150. A two-piece crank arm 159 having a handle 168 is attached to the end of the two-piece crank arm 159 opposite from the axis 157 of the shaft 158. The firehose winder mechanism 153 further comprises a center mount plate 154 attached to the shaft 158 and positioned on a side of the horizontal main stay tube 150 opposite that of the two-piece crank arm 159. Two hose mount pins 156 are attached to and extend away from the center mount plate 154 where the two hose mount pins 156 are configured to receive and releasably secure the firehose 50. The two hose mount pins 156 are positioned away from the axis 157 of the shaft 158.

As shown in FIG. 6, the two-piece crank arm 159 comprises a near portion 160 and a far portion 162 where the near portion 160 is attached to the shaft 158 where the length of the near portion 160 is perpendicular to the axis 157 of the shaft 158. The far portion 162 is movably coupled to the near portion 160 and has a handle 168.

In an embodiment, the near portion 160 is formed as a hollow rectangular tube which is dimensioned to receive the far portion 162 which also may be formed from a hollow rectangular tube. In an embodiment, the far portion 162 has a plurality of indexing holes 164 along its length. The near portion 160 has a retractable pin 166 which is configured to engage with the indexing holes 164 formed in the outer portion 162. As such, the user may adjust the length of the two-piece crank arm 159 by pulling on the retractable pin 166 on the near portion 160, sliding the far portion 162 into a desired position relative to the near portion 160, and then releasing the retractable pin 166 into one of the indexing holes 164 in the far portion 162 to secure the far portion 162 relative to the near portion 160.

Figure 6B:
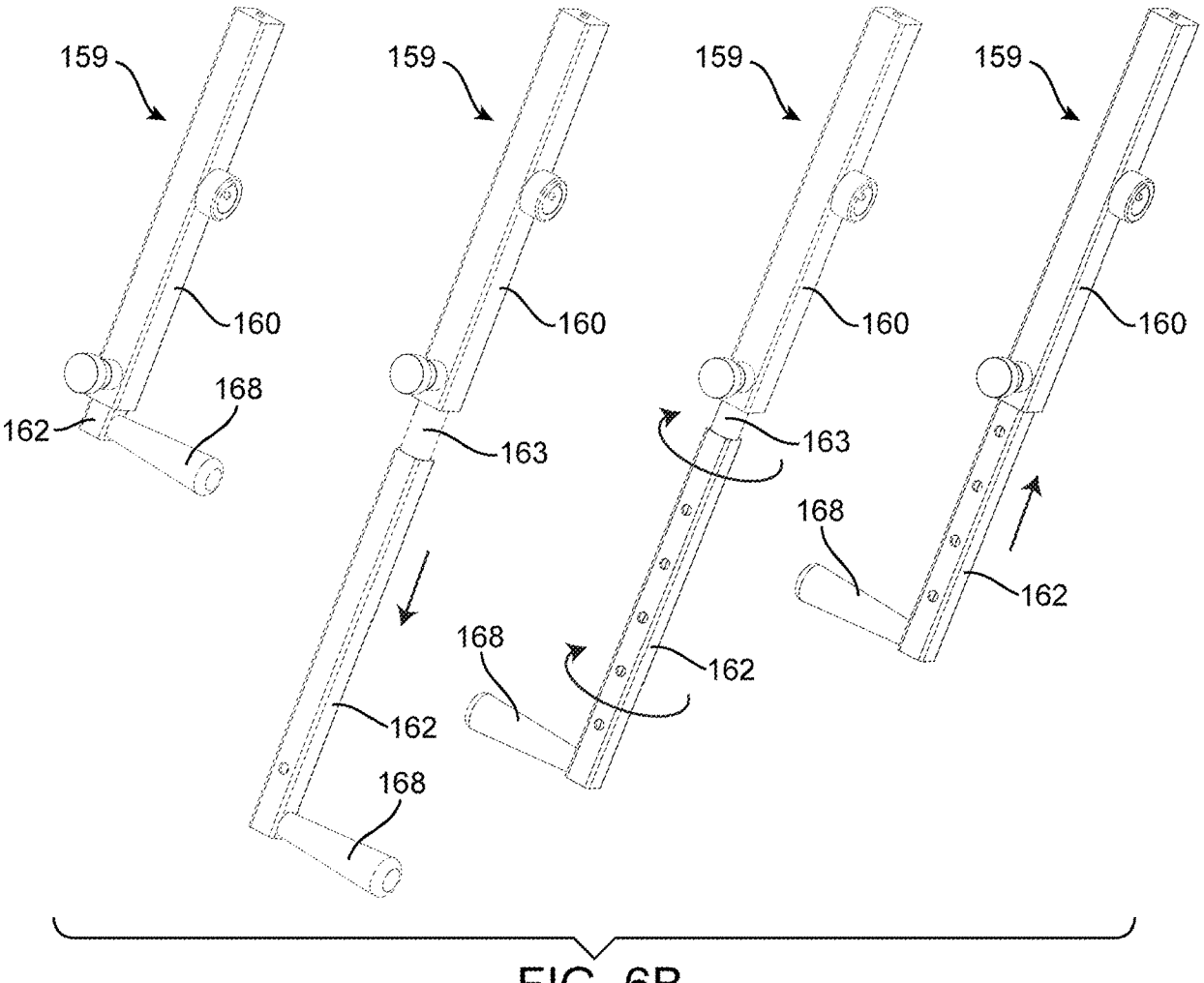
FIG. 6B is a sequence of perspective views showing how the far portion may be adjusted relative to the near portion to lengthen or shorten the crank arm as desired, and to direct the handle inward for compact storage and outward for use in winding a firehose.
Figure 6A:
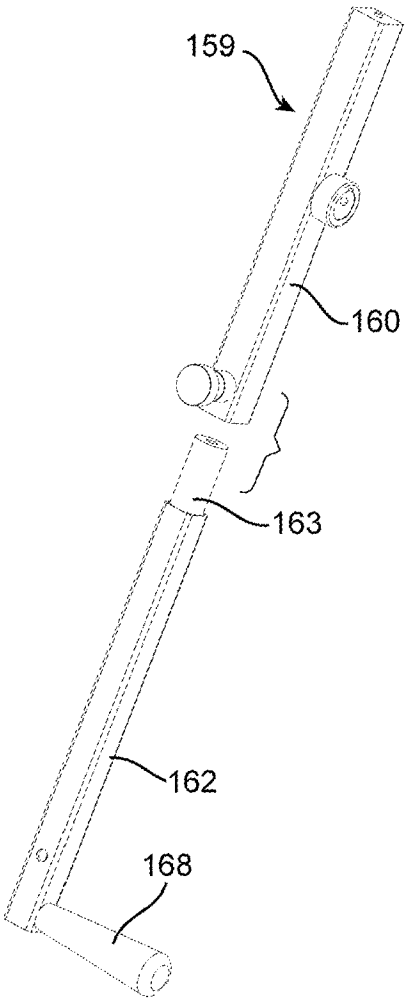
FIG. 6A is an exploded perspective view of the near and far portions of the adjustable crank arm.

Moreover, the far portion 162 is configured to be axially rotatable within the near portion 160 when the far portion 162 is fully extended from the near portion 160. In an embodiment, as best shown in FIGS. 6A and 6B, the far portion 162 may have a circular tubular section 163 at the end of the rectangular tubular section (not separately numbered) which allows the user to rotate the far portion 162 relative to the near portion 160.

The two-piece crank arm 159 may be set up as follows. First, as shown in FIG. 5, the user finds the handle 168 secured to the horizontal main stay tube 150 with a storage clip 170. Second, the user disengages the two-piece crank arm 159 from the storage clip 170 by pulling out the retractable pin 166 and then extending the far portion 162 relative to the near portion 160 until the handle 168 is no longer retained by the storage clip 170. Third, the user continues to pull the far portion 162 outward until its square profile is no longer inside of the near portion 160 and it can be rotated relative thereto. Fourth, the user then rotates the far portion 162 by 180 degrees so that the handle 160 is extending away from the assembly 105, rather than toward the assembly 105, as shown by the arcuate arrows in FIG. 6. Fifth, the user then adjusts the length of the two-piece crank arm 159 by pulling the retractable pin 166, adjusting the position of the far portion 162 relative to the near portion 160 by sliding the far portion 162 back into the near portion 160 to set the length of the crank arm 159 to the desired length, and then releasing the retractable pin 166 so that it engages with one of the indexing holes 164 of the far portion 162, thereby locking the near portion 160 and far portion 162 to one another at that desired length.

Returning to FIGS. 6A and 6B, the preferred far portion 162 is formed from a rectangular tubular section which has a square profile and a circular tubular section 163 at the end thereof which has a circular profile. In the preferred embodiment, a length of all-thread rod is used to allow the far portion 162 to be almost, but not completely pulled out of the near portion 162, thereby exposing part of the circular tubular section 163 and allowing the user to rotate the far portion 162, and its handle 168, as desired. This unique configuration allows the crank arm 159 to be lengthened or shortened, as desired, and to have the handle 168 extending in one direction for compact storage and extending in the opposite direction for use in winding up a firehose.

Figure 7:
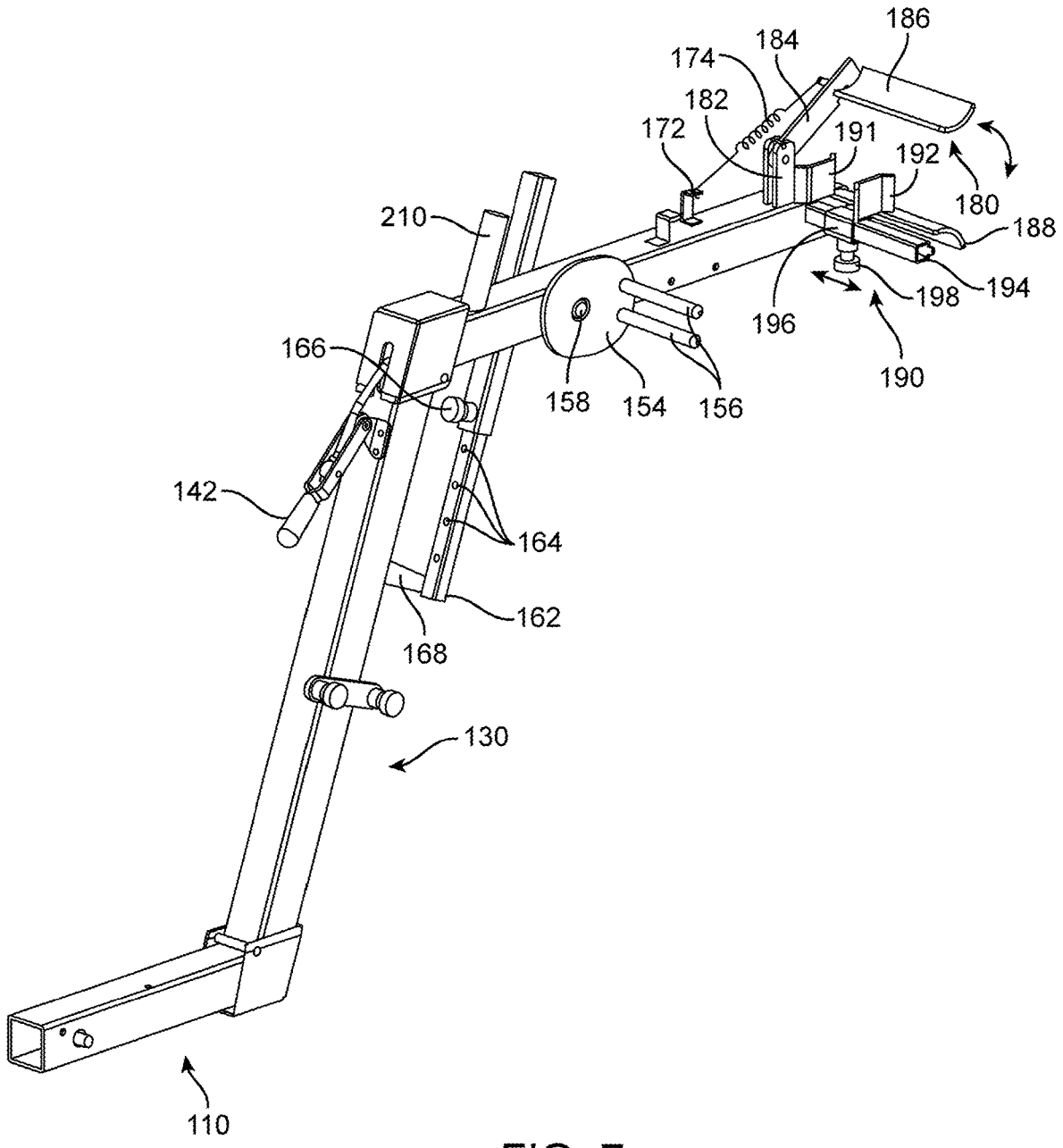
FIG. 7 is a side, perspective view of the firehose winder where the hold-down mechanism is positioned to accept a firehose.
Figure 9:
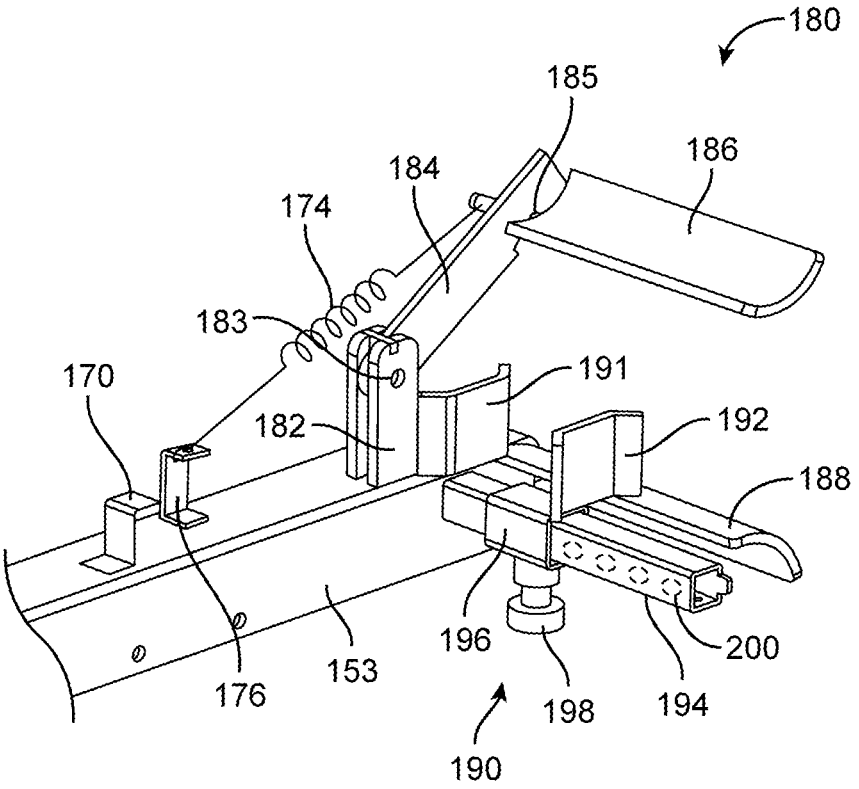
FIG. 9 is a closeup, side, perspective view showing details of the hold-down and the adjustable width adjustment mechanisms.

The hold-down mechanism 180 is illustrated in FIGS. 6, 7, and 9. FIG. 7 is a side, perspective view of the firehose winder 101 where the hold-down mechanism 180 is positioned to accept a firehose 50. FIG. 9 is a side, perspective view showing details of the hold-down mechanism 180 and adjustable width mechanism 190. The hold-down mechanism 180 is mounted on the horizontal main stay tube 150. The hold-down mechanism 180 comprises a lower slide hold-down 182 attached to the horizontal main stay tube 150, and an upper slide hose-down 186. The hold-down mechanism 180 applies a downward force on the firehose 50 as the firehose 50 is wound onto the firehose winder mechanism 153. The hold-down mechanism 180 retrains the firehose 50 from moving in a vertical direction, and may tend to squeeze the firehose 50 to remove excess water remaining in the firehose 50. The hold-down mechanism 180 comprises a lower slide hose hold down 188 coupled to the horizontal main stay tube 150 and an upper slide hose down 186 for applying a force to the firehose 50 as it traverses the firehose winder 101.

The hold-down mechanism 180 further comprises a hold-down vertical extension 182, which is pivotably coupled to a hold-down arm 184, which, in turn, is coupled to the upper slide hose down 186. A spring 174 is positioned between the spring hose down 172 and the upper hose down 186 applies a downward force onto the firehose 50 as it traverses the firehose winder 101. The lower slide hose down 188 has a first length perpendicular to the horizontal main stay tube 150 and a first curved contour formed perpendicular to the length of the lower slide hose hold down 188. The hold-down mechanism 180 has an arm rotatably coupled to the horizontal main stay tube 150, an upper slide hose hold 186 down rotatably coupled to the arm 182, the upper slide hose down 186 having a second length perpendicular to the horizontal main stay tube 150 and a second curved contour formed perpendicular to the length of the upper slide hose hold down, and a spring 174 coupling the horizontal main stay tube 150 and the upper slide hose, the spring 174 urging a downward force onto the firehose 50. FIG. 7 shows the hold-down mechanism 180 open and ready to accept a firehose 50, and FIG. 6 shows the hold-down mechanism 180 engaging with and applying a downward force to the firehose 50.

Figure 8:
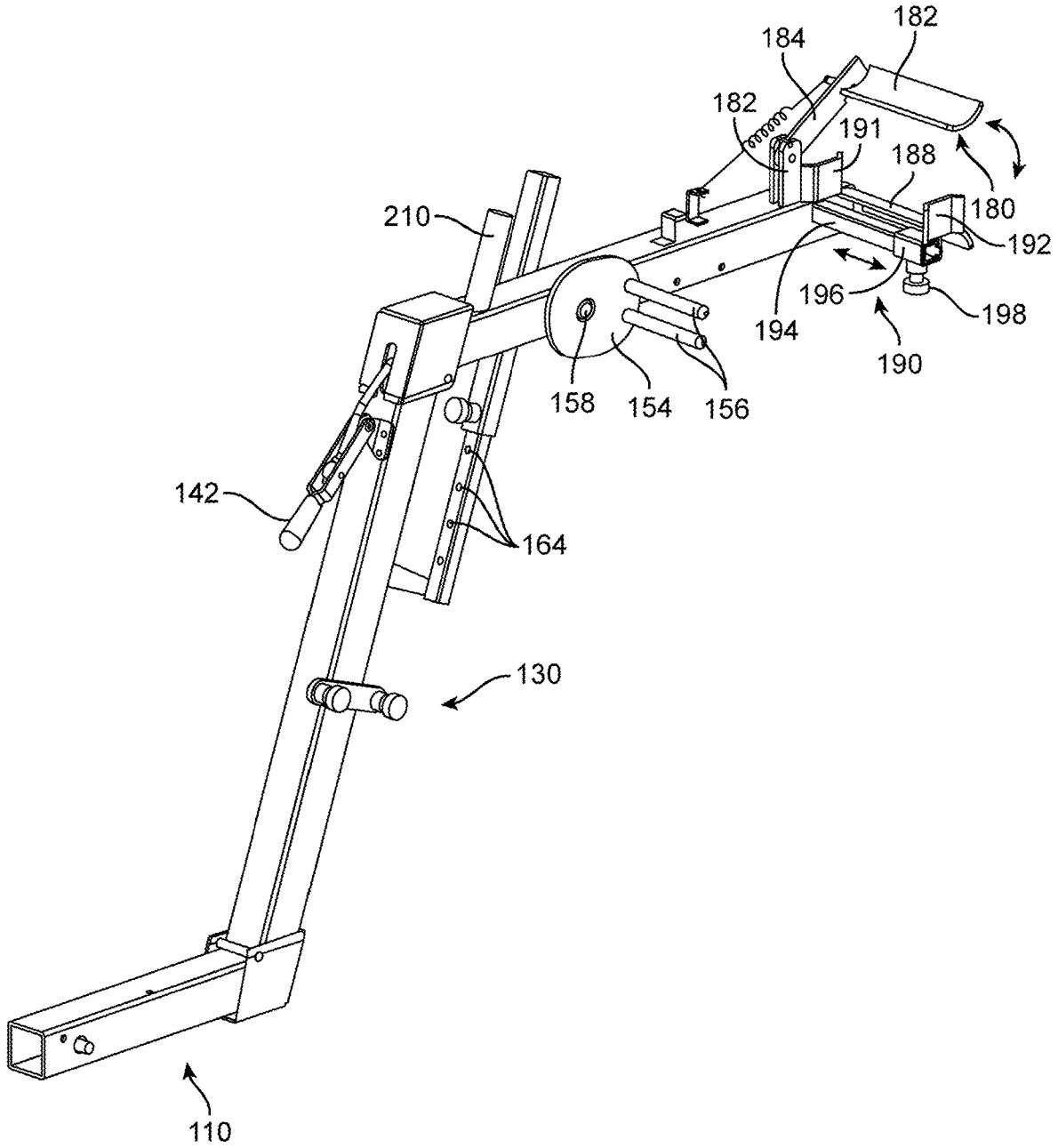
FIG. 8 is a side, perspective view of the firehose winder where the adjustable width mechanism is positioned to accept and guide a firehose.

The adjustable width mechanism 190 is illustrated in FIGS. 7, 8, and 9. FIG. 8 is a side, perspective view of the firehose winder where the adjustable width mechanism is positioned to accept and guide a firehose. The adjustable width mechanism 190 aligns and guides the firehose 60 laterally as the firehose 50 is wound onto the firehose winder mechanism 153. In an embodiment, the adjustable width mechanism 190 comprises a fixed hose guide 191 and a hose sizer tube 194 having a plurality of index holes 200. The hose sizer tube 194 is attached to and extends laterally away from the horizontal main stay tube 150. A guide slider 196 is movable coupled to the hose sizer tube 194, where the guide slider 196 has a retractable pin 198 for engaging with the index holes 200. A movable hose 192 guide is coupled to the guide slider 196. As shown in FIG. 6, the adjustable width mechanism 190 is placed to accept a narrow firehose 50, and as shown in FIG. 8, the adjustable width mechanism 190 is placed to accept a wider firehose 50

Although the invention has been discussed with reference to specific embodiments, it is apparent and should be understood that the concept can be otherwise embodied to achieve the advantages discussed. The preferred embodiments above have been described primarily as portable firehose winders. In this regard, the foregoing description of the firehose winders is presented for purposes of illustration and description.

Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. A firehose winder comprising:

an assembly comprising a tongue for connecting to a hitch of a vehicle;

a riser hingeably connected to the tongue;

a horizontal main stay tube hingeably connected to the riser; and a firehose winder mechanism attached to the horizontal main stay tube and configured to receive and wind a firehose;

wherein the tongue, the riser, and the horizontal main stay tube of the assembly are movable between a closed configuration for stowing the firehose winder and an open configuration where the horizontal main stay tube is reversibly locked and displaced substantially vertically with respect to the tongue.

2. The firehose winder of claim 1, wherein when the assembly is in the closed configuration, the riser is positioned immediately adjacent to and substantially parallel with the tongue, and the horizontal main stay tube is positioned immediately adjacent to and substantially parallel with the riser.

3. The firehose winder of claim 1, wherein the firehose winder mechanism further comprises:

a shaft extending through the horizontal main stay tube;

a crank arm attached to the shaft;

a handle attached to the crank arm;

a center mount plate attached to the shaft and positioned on a side of the horizontal main stay tube opposite the crank arm; and two hose mount pins attached to and extending away from the center mount plate, the two hose mount pins configured to receive and wind the firehose;

wherein the crank arm is a two-piece crank arm formed from a near portion that is nearer to and attached to the shaft and a far portion that is further from the shaft, the handle attached to a distal end of the far portion, the near and far portions being extensible relative to one another, whereby the handle may be moved closer to or further from an axis of the shaft.

4. The firehose winder of claim 1, wherein the firehose winder mechanism comprises:

a shaft positioned through at least one hole formed in the horizontal main stay tube;

a two-piece crank arm comprising a near portion and a far portion, the near portion attached to the shaft where the length of the near portion is perpendicular to an axis of the shaft, the far portion movably coupled to the near portion;

a handle attached to the far portion;

a center mount plate attached to the shaft and positioned on a side of the horizontal main stay tube opposite the two-piece crank arm; and, two hose mount pins attached to and extending away from the center mount plate, the two hose mount pins configured to receive and wind the firehose.

5. The firehose winder of claim 1, further comprising a hold-down mechanism mounted on the horizontal main stay tube for applying a downward force on the firehose as the firehose is wound onto the firehose winder mechanism.

6. The firehose winder of claim 5, the hold-down mechanism comprising:

a lower slide hose hold-down coupled to the horizontal main stay tube, the lower slide hose down having a first length perpendicular to the horizontal main stay tube and a first curved contour formed perpendicular to the length of the lower slide hose hold-down;

an arm rotatably coupled to the horizontal main stay tube;

an upper slide hose hold-down rotatably coupled to the arm, the upper slide hose down having a second length perpendicular to the horizontal main stay tube and a second curved contour formed perpendicular to the length of the upper slide hose hold-down; and, a spring coupling the horizontal main stay tube and the upper slide hose, the spring urging a downward force onto the firehose.

7. The firehose winder of claim 1, further comprising an adjustable width mechanism for aligning and guiding the firehose laterally as the firehose is wound onto the firehose winder mechanism.

8. The firehose winder of claim 7, wherein the adjustable width mechanism comprises:

a fixed hose guide;

a hose sizer tube having a plurality of index holes, the hose sizer tube attached to and extending laterally away from the horizontal main stay tube;

a guide slider movable coupled to the hose sizer tube, the guide slider having a retractable pin for engaging with the index holes; and a movable hose guide coupled to the guide slider.

9. The firehose winder of claim 1, further comprising:

a stow pin mount plate attached to the riser, the stow pin mount plate having a length extending perpendicular from a length of the riser;

a first retractable pin connected to the stow pin mount plate, the first retractable pin configured to secure the horizontal main stay tube adjacent to the riser; and, a second retractable pin connected to the stow pin mount plate, the second retractable pin configured to secure the horizontal main stay tube adjacent to the tongue.

10. The firehose winder of claim 1, wherein the assembly further configures a toggle clamp for removably locking the horizontal main stay tube in place when the assembly is in the open configuration.

11. A firehose winder comprising:

an assembly comprising:

a tongue for connecting to a hitch of a vehicle;

a riser hingeably connected to the tongue;

a horizontal main stay tube hingeably connected to the riser; and, a firehose winder mechanism attached to the horizontal main stay tube configured to receive and wind a firehose, the firehose winder mechanism having an adjustable crank arm with a handle where the handle may be moved relative to an axis of the shaft.

12. The firehose winder of claim 11, wherein the tongue, the riser, and the horizontal main stay tube of the assembly are movable between a closed configuration for stowing the firehose winder and an open configuration where the horizontal main stay tube is reversibly locked and displaced vertically with respect to the tongue.

13. The firehose winder of claim 11, wherein when the assembly is in the closed configuration, the riser is positioned immediately adjacent to and parallel with the tongue, and the horizontal main stay tube is positioned immediately adjacent to and parallel with the riser.

14. The firehose winder of claim 11, further comprising a hold-down mechanism mounted on the horizontal main stay tube for applying a downward force on the firehose as the firehose is wound onto the firehose winder mechanism.

15. The firehose winder of claim 14, the hold-down mechanism comprising:

a lower slide hose hold-down coupled to the horizontal main stay tube, the lower slide hose down having a first length perpendicular to the horizontal main stay tube and a first curved contour formed perpendicular to the length of the lower slide hose hold-down;

an arm rotatably coupled to the horizontal main stay tube;

an upper slide hose hold-down rotatably coupled to the arm, the upper slide hose down having a second length perpendicular to the horizontal main stay tube and a second curved contour formed perpendicular to the length of the upper slide hose hold-down; and, a spring coupling the horizontal main stay tube and the upper slide hose, the spring urging a downward force onto the firehose.

16. The firehose winder of claim 11, further comprising an adjustable width mechanism for aligning and guiding the firehose as the firehose is wound onto the firehose winder mechanism.

17. The firehose winder of claim 16, wherein the adjustable width mechanism comprises:

a fixed hose guide;

a hose sizer tube having a plurality of index holes, the hose sizer tube attached to and extending laterally away from the horizontal main stay tube;

a guide slider movable coupled to the hose sizer tube, the guide slider having a retractable pin for engaging with the index holes; and a movable hose guide coupled to the guide slider.

18. The firehose winder of claim 11, further comprising:

a stow pin mount plate attached to the riser, the stow pin mount plate having a length extending perpendicular from a length of the riser;

a first retractable pin connected to the stow pin mount plate, the first retractable pin configured to secure the horizontal main stay tube adjacent to the riser; and, a second retractable pin connected to the stow pin mount plate, the second retractable pin configured to secure the horizontal main stay tube adjacent to the tongue.

19. A firehose winder comprising:

an assembly comprising:

a tongue for connecting to a hitch of a vehicle;

a riser hingeably connected to the tongue;

a horizontal main stay tube hingeably connected to the riser;

a firehose winder mechanism attached to the horizontal main stay tube and configured to receive and wind a firehose; and, a hold-down mechanism mounted on the horizontal main stay tube for applying a downward force on the firehose as the firehose is wound onto the firehose winder mechanism.

20. The firehose winder of claim 19, the hold-down mechanism comprising:

a lower slide hose hold-down coupled to the horizontal main stay tube, the lower slide hose down having a first length perpendicular to the horizontal main stay tube and a first curved contour formed perpendicular to the length of the lower slide hose hold-down;

an arm rotatably coupled to the horizontal main stay tube;

an upper slide hose hold-down rotatably coupled to the arm, the upper slide hose down having a second length perpendicular to the horizontal main stay tube and a second curved contour formed perpendicular to the length of the upper slide hose hold-down; and, a spring coupling the horizontal main stay tube and the upper slide hose, the spring urging a downward force onto the firehose.

* * * * *